US005156404A

United States Patent [19]

Oka et al.

[11] Patent Number: 5,156,404

[45] Date of Patent: Oct. 20, 1992

[54] GOLF BALL

[75] Inventors: Kengo Oka, Kobe; Yoshikazu Yabuki, Akashi; Kiyoto Maruoka, Kobe, all of Japan

[73] Assignee: Sumitomo Rubber Industries, Ltd., Hyogo, Japan

[21] Appl. No.: 680,765

[22] Filed: Apr. 5, 1991

[30] Foreign Application Priority Data

Sep. 18, 1990 [JP] Japan ..... 2-249880

[51] Int. Cl.[5] ..... A63B 37/14

[52] U.S. Cl. ..... 273/232

[58] Field of Search ..... 273/232; 40/327

[56] References Cited

U.S. PATENT DOCUMENTS 4,266,773 5/1981 Treafwell ..... 273/232

4,744,564 5/1988 Yamada ..... 273/232

FOREIGN PATENT DOCUMENTS 90066928 10/1990 Fed. Rep. of Germany .

61-284264 12/1986 Japan .

2176409 12/1986 United Kingdom .

*Primary Examiner*—George J. Marlo

[57] ABSTRACT

A golf ball has one great circle and four one-half great circles which all intersect no dimples. Eight end points which include two end points of each one-half great circle are formed at the one great circle. These end points do not coincide with each other on the great circle. One of the one-half great circles intersects the other one-half great circle at a right angle at the middle point thereof on each of the great circle. In other words, an upper semispherical mold for an octahedral dimple golf ball arrangement is rotated a certain angle relative to the lower mold such that two of the three great circles are divided into four one-half great circles. The parting line of the mold becomes the one remaining great circle. In this manner, a more uniform flight of the golf ball canbe obtained regardless of whether the ball is hit on a seam, semi-seam of non-seam area.

5 Claims, 12 Drawing Sheets

GOLF BALL

BACKGROUND OF THE INVENTION

1. Field of the Invention

The present invention relates to a golf ball, and more particularly, to the golf ball having no difference in its flight performance irrespective of the position of the rotational axis thereof. To this end, the aerodynamic symmetrical property of the golf ball is improved by providing a novel arrangement of great circles not intersecting dimples arranged according to a regular octahedron and volumes of dimples according to zones of the golf ball.

2. Description of the Related Arts

Normally, 300 to 550 dimples are formed on the surface of a golf ball to improve the aerodynamic characteristic thereof and as such increase the flight distance thereof. Of various proposals which have been hitherto made to improve the dimple arrangement of the golf ball, regular octahedral dimple arrangement has been most widely adopted because the regular dimple octahedral arrangement is orderly in design and favorable in symmetrical property.

As shown in FIG. 8, according to the regular octahedral dimple arrangement, the spherical surface of a golf ball 1 is divided into eight spherical triangles by projecting ridge lines 2*a* of an octahedron 2 which inscribes the golf ball 1 on the spherical surface of the golf ball 1, then dimples are arranged equivalently inside each spherical triangle. The lines corresponding to the ridge lines 2*a* projected on the spherical surface of the golf ball 1 form three great circles 3, 4, and 5 not intersecting dimples. One of the great circles 3, 4, and 5, for example, the great circle 3 intersects at right angles with the other great circles 4 and 5 each at two points 4*a*, 4*b*, and 5*a*, 5*b*.

Normally, the golf ball is molded by a pair of upper and lower semispherical molds. Therefore, dimples cannot be arranged on the parting line on which the upper and lower molds contact with each other. For example, in the golf ball 1 having regular octahedral dimple arrangement, one of the three great circles 3, 4, and 5 is on the parting line which is called the seam. According to the regular octahedral dimple arrangement, since no dimples are arranged on the other two great circles, these two great circles are equivalent to the seam. Therefore, they are called semi-seam. Assuming that the great circle 3 is the seam as shown in FIG. 9, the great circles 4 and 5 are semi-seams. That is, according to the regular octahedral dimple arrangement, the golf ball 1 has one seam 3 and two semi-seams 4 and 5.

The golf ball flies with backspin when it is hit by a golf club. Preferably, the golf ball has no difference in trajectory height and flight distance even though the rotational axis of the backspin is different. If the flight performance of the golf ball is varied due to a different hitting point, namely, the shift of a rotational axis, the golf ball cannot display a player's ability faithfully.

The method for hitting the golf ball having the regular octahedral dimple arrangement is divided into the following three kinds owing to the shift of the rotational axis of the backspin caused by a varied hitting position:

Seam hitting: The golf ball 1 is hit such that a circumference which rotates fastest in its backspin concides with the seam 3.

Semi-seam hitting: The golf ball 1 is hit such that the circumference which rotates fastest in its backspin concides with the semi-seam 4 or 5.

Non-seam hitting: The golf ball 1 is hit such that a circumference which rotates fastest in its backspin doesn't concide with the seam 3, the semi-seam 4 and 5.

In the golf ball 1 having the regular dimple octahedral arrangement, the trajectory height thereof in seam-hitting and semi-seam hitting is lower than in non-seam hitting, and the duration of flight in seam-hitting and semi-seam hitting is shorter than in non-seam hitting. This is because a great circle having no dimples arranged on the circumference which rotates fastest in its backspin and consequently, the dimple effect of the golf ball in seam-hitting and semi-seam hitting is not displayed as favorably as in non-seam hitting. Since the dimple arrangement in seam hitting and in semi-seam hitting is equivalent to each other, the dimple effect of both hittings is similar. Therefore, the trajectory height and duration of flight in semi-seam hitting and seam hitting are similar to each other.

As apparent from the foregoing description, in the golf ball having regular octahedral dimple arrangement, it has a difference in the flight distance and aerodynamic symmetrical property among non-seam hitting, seam hitting, and semi-seam hitting.

In order to improve the aerodynamic characteristic which is deteriorated owing to the difference in the hitting position of the golf ball caused by the seam on which dimples are not formed, the present applicant proposed a dimple arrangement in Japanese Patent Laid-Open Publication No. 61-284264. According to this dimple arrangement, the volumes of dimples positioned in the vicinity of the seam are greater than those of dimples positioned in the vicinity of the poles.

Applying this dimple arrangement to the golf ball having regular octahedral dimple arrangement, in seam hitting, dimples positioned in the vicinity of the circumference which rotates fastest in its backspin have all great volumes. Consequently, the golf ball has an improved dimple effect, thus having a trajectory similar to that in non-seam hitting.

However, in the golf ball in which the volumes of dimples positioned in the vicinity of the seam are greater than those of dimples positioned in the vicinity of the poles, the trajectory in semi-seam hitting is lower than that in non-seam hitting and the duration of flight is shorter in semi-seam hitting than that in non-seam hitting. This is because in semi-seam hitting, all dimples positioned in the vicinity of a circumference which rotates fastest in its backspin do not have greater volume, but both dimples of the greater volumes and smaller volumes are arranged there.

SUMMARY OF THE INVENTION

It is therefore the object of the present invention to eliminate the difference in trajectory heights between non-seam hitting and seam hitting as well as semiseam hitting so as to provide a golf ball having a favorable aerodynamic symmetrical property.

In accomplishing these and other objects, the present invention provides a golf ball having one great circle and four one-half great circles intersecting no dimples in which eight end points consisting of two end points of each one-half great circle do not coincide with each other on the great circle; and one one-half great circle intersects the other one-half great circle at a right angle at the middle point thereof.

That is, the golf ball of the present invention has a regular octahedral dimple arrangement. The upper semispherical mold is rotated a certain angle relative to a lower mold so as to divide each of two semi-seams into two one-half great circles by the great circle corresponding to the seam on the parting line serving as the boundary. Therefore, the golf ball has one great circle and four one-half great circles.

Preferably, of the eight end points, the central angle $\phi$ formed by lines connecting the center of the golf ball and each of two adjacent end points is set in the following range: $5° \leqq \phi \leqq 45°$. Namely, the shift angle $\phi$ between the upper mold and the lower mold which form the golf ball having regular octahedral dimple arrangement is set as $5° \leqq \phi \leqq 45°$.

Further, according to the golf ball, the specification of a dimple arranged in an S spherical zone and the specification of a dimple arranged in a P spherical zone are determined so that VS/VP is in the range:

$$1.02 \leqq VS/VP \leqq 1.25$$

where S spherical zone ranges from the seam to each of the circumferences formed in correspondence with a central angle of less than approximately 60° with respect to the seam; P spherical zone ranges from the circumferences to each pole; VS is the volume of a dimple arranged in S spherical zone; and VP is the volume of a dimple, having the same curvature as that of the dimple of S spherical zone, arranged in P spherical zone.

Preferably, the boundary line between P zone and S zone to the center of the golf ball makes an angle of $10° \leqq \theta < 60°$ with the seam.

According to the golf ball of the above construction, compared with dimples arranged according to a regular octahedron, the aerodynamic symmetrical property can be improved by forming the golf ball by dislocating the connecting angle of the upper and lower molds a certain extent. That is, in hitting the golf ball in such a manner that one of the semi-great circles having no dimples arranged thereon coincides with the circumference which is fastest in its backspin, the semi-great circle coincides with the circumference which is fastest in its backspin per one-half rotation thereof. This way of hitting the golf ball is hereinafter referred to as half-seam hitting. In this case, the golf ball has a dimple effect similar to that obtained by hitting a semi-seam of a golf ball having dimples arranged according to a regular octahedron. Per other one-half rotation of the golf ball, a portion on which dimples are arranged coincides with a circumference which rotates fastest. In this case, the golf ball has a dimple effect similar to that obtained by hitting a non-seam of a golf ball having dimples arranged according to a regular octahedron. Accordingly, in half-seam hitting, the golf ball has a dimple effect intermediate between non-seam hitting and semi-seam hitting.

The volume of a dimple in the zone in the vicinity of the seam is greater than that of a dimple in the zone in the vicinity of the poles. Therefore, unlike the conventional golf ball in which aerodynamic symmetrical property is damaged due to the existence of the seam depending on a hitting position, the golf ball according to the present invention has a favorable aerodynamic symmetrical property. As such, the difference in trajectories in seam hitting, non-seam hitting, and half-seam hitting can be reduced, so that the flight performance of the golf ball can be uniformalized.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

These and other objects and features of the present invention will become apparent from the following description taken in conjunction with the preferred embodiments thereof with reference to the accompanying drawings which are given by way of illustration only, and thus are not limitative of the present invention, and in which.

DETAILED DESCRIPTION OF THE INVENTION

Figure 1:
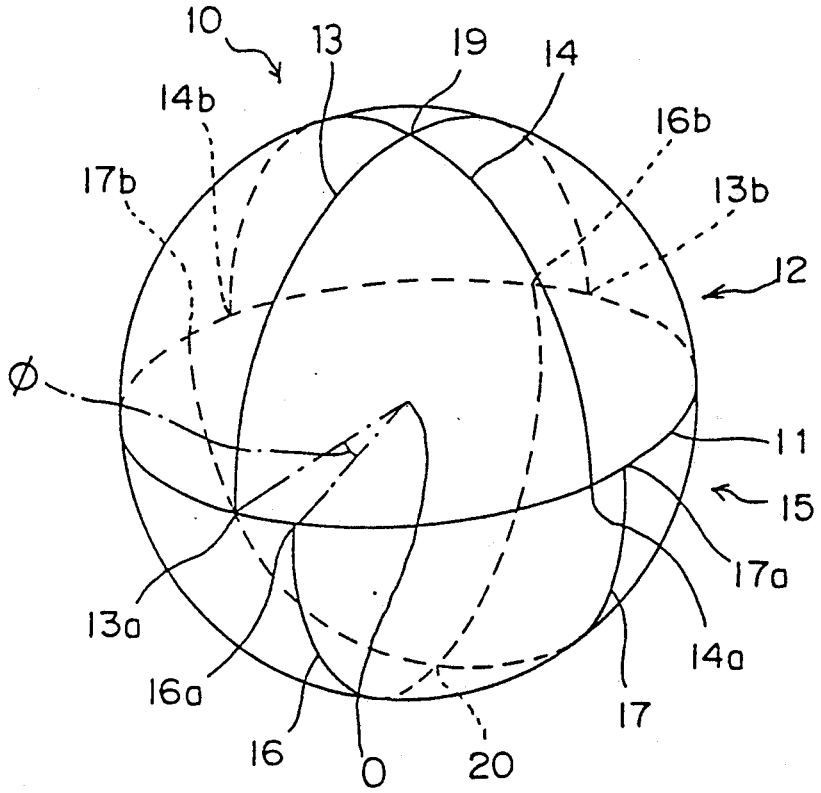
FIG. 1 is a schematic perspective view showing a golf ball in accordance with the present invention.

Before the description of the present invention proceeds, it is to be noted that like parts are designated by like reference numerals throughout the accompanying drawings.

Figure 9:
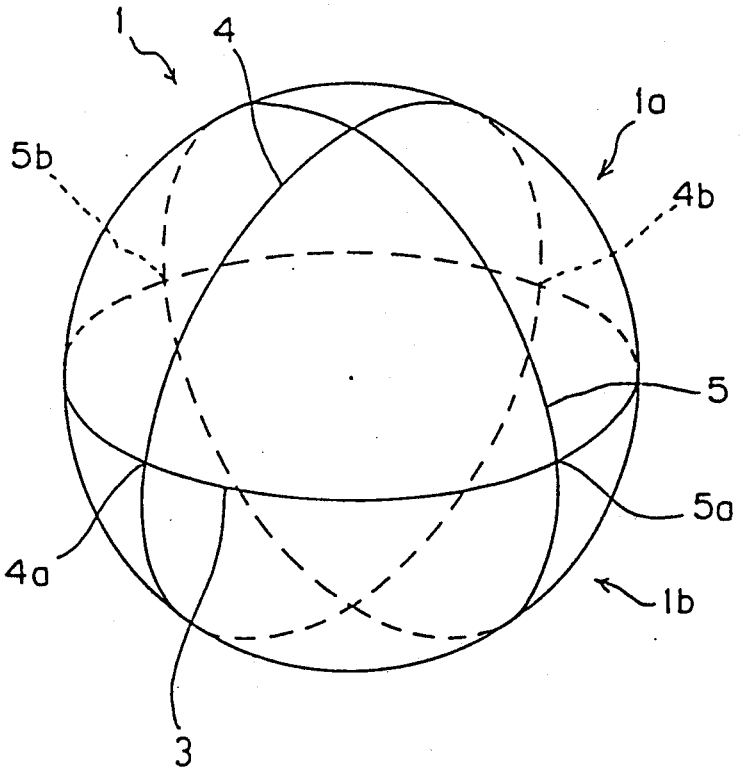
FIG. 9 is schematic perspective view showing a golf ball having regular octahedral dimple arrangement.

Referring to FIGS. 1 and 9, the outline of the golf ball according to the present invention is described below. Dimples are arranged on the surface of the golf ball based on a regular octahedron. Therefore, the golf ball has a great circle corresponding to the seam between an upper mold and a lower mold and two semi-seams. The upper mold is rotated a certain angle with respect to the lower mold so that the two semi-seams are each divided into two one-half great circle by the seam. That is, the golf ball has two half-divided, or one-half great circles formed in the upper semispherical surface thereof and two one-half great circles formed in the lower semispherical surface thereof, totaling four semi-seams in addition to one great circle formed on the seam.

More specifically, as shown in FIG. 1, the upper semi-sphere 12 of the golf ball 10 has two one-half great circles 13 and 14 perpendicular to each other at the middle point thereof. The end points 13*a* and 13*b* of the one-half great circle 13 and the end points 14*a* and 14*b* of the one-half great circle 14 are tangent to the great circle 11. The lower semi-sphere 15 of the golf ball 10 has also two one-half great circles 16 and 17 perpendicular to each other at the middle point thereof. The end points 16*a* and 16*b* of the one-half great circle 16 and the end points 17*a* and 17*b* of the one-half great circle 17 are also tangent to the great circle 11. That is, the golf ball 10 has one great circle 11 corresponding to the parting line between the upper and lower molds and the four one-half great circles, 13, 14, 16, and 17.

As described above, due to the formation of the four one-half great circles 13, 14, 16, and 17, the eight end points are formed on the great circle 11 such that each of the positions of a pair of the adjacent end points 13*a* and 16*a*, 13*b* and 16*b*, 14*a* and 17*a*, and 14*b* and 17*b* is at different position on the great circle 11. That is, the great circle 11 intersects the eight end points of the one-half great circles 13, 14, 16, and 17 in such a manner that the angle made by the two lines connecting the center point (0) of the golf ball 10 and each of two adjacent end points, for example, 13*a* and 16*a*, namely, the shift angle $\phi$ between the upper mold and the lower mold is set as follows:

$$5° \leqq \phi \leqq 45°$$

The above shift angle range was obtained by experimental results. The reason $\phi$ is more than 5° is as follows: If $\phi$ is less than 5°, each interval between the end points 13*a* and 16*a*, 13*b* and 16*b*, 14*a* and 17*a*, and 14*b* and 17*b* is close to each other. As a result, a pair of the upper one-half great circle 13 and the lower one-half great circle 16 and a pair of the upper one-half great circle 14 and the lower one-half great circle 17 form a spherical line approximate to a semi-seam, respectively. Therefore, in the golf ball having regular octahedral dimple arrangement, the dimple effect in half-seam hitting described previously is similar to the dimple effect semi-seam hitting. That is, there is a difference between the trajectory in half-seam hitting and in non-seam hitting. The reason the shift angle $\phi$ is less than 45° is as follows: Since the great circle corresponding to the seam intersects the four one-half great circles at the eight points, $\phi$ cannot be more than 45°.

Although not shown in FIG. 1, the golf ball 10 has a lot of dimples arranged on the surface thereof in such a manner that they do not intersect the great circle 11 or four one-half great circles 13, 14, 16, and 17. Each dimple is circular in the surface thereof and has a different curvature as described later.

Figure 2:
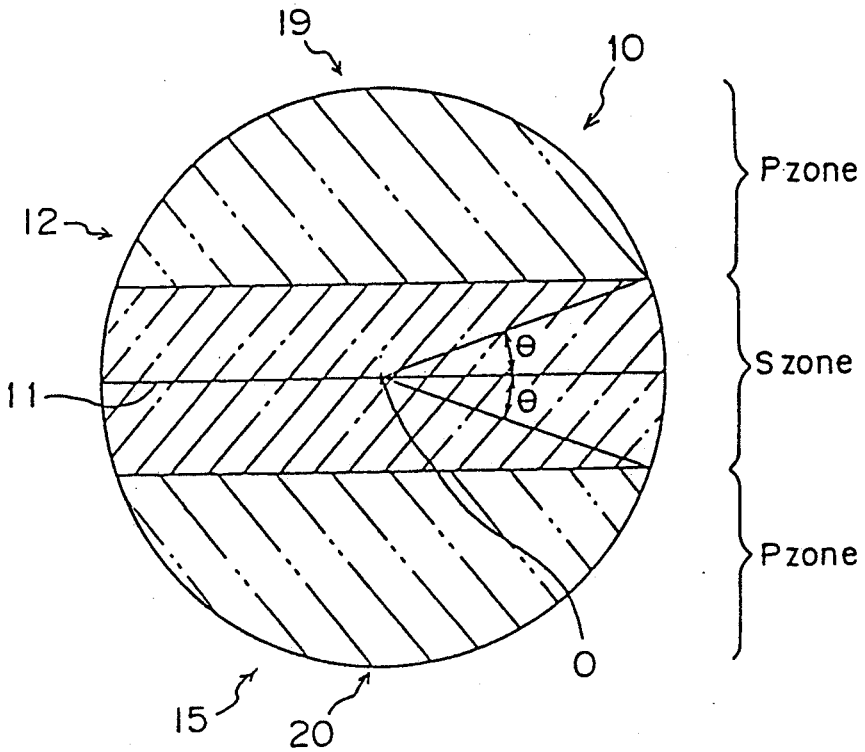
FIG. 2 is a schematic view showing the relationship between a P zone and an S zone.

As shown in FIG. 2, the surface of the golf ball 10 is divided into an S spherical zone and a P spherical zone. As shown by one-dot chain lines, S spherical zone ranges from the great circle 11 to each of circumferences formed in correspondence with a central angle of the golf ball 10 of less than $\theta$ ($10° \leqq \theta < 60°$) with respect to the great circle 11. As shown by two-dot chain lines, P spherical zone includes a zone ranging from the upper circumference to the pole 19 and a zone ranging from the lower circumference to the pole 20. Therefore, the angle made by the center of a dimple arranged in P zone with the great circle 11 is more than $\theta$. Of dimples having the same curvature, the volume of the dimple arranged in S zone is differentiated from that of the dimple arranged in P zone.

Assuming that of dimples having the same curvature $\rho$, the volume of a dimple having the center thereof positioned in S zone is VS and the volume of a dimple having the center thereof positioned in P zone is VS, the ratio of the volume of the dimple in P zone to the volume of the dimple in S zone is set as follows:

$$1.02 \leqq VP/VP \leqq 1.25$$

Figure 3:
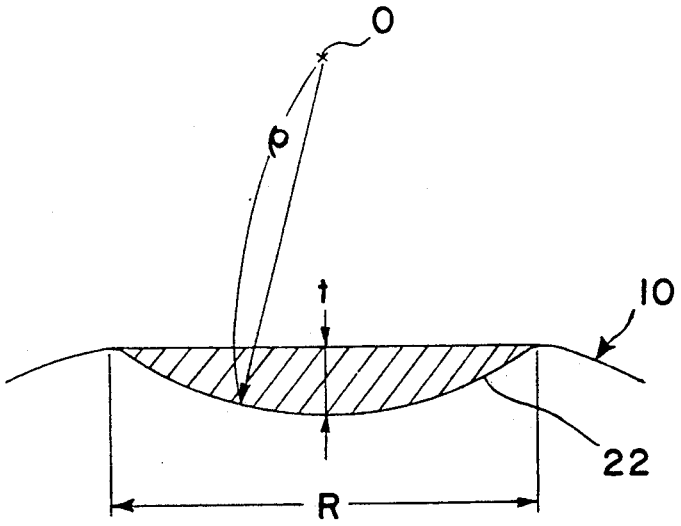
FIG. 3 is a schematic sectional view showing the configuration of a dimple.

As shown in FIG. 3, a desired dimple volume VS and VP of the same curvature is obtained by varying the diameter (R) which is the length of a line tangent to both end of the dimple 22 and a depth (t) which is the length of the perpendicular dropped from the line tangent to both end of the dimple 22 to the deepest point of the dimple 22.

The range of volume ratio of VS to VP is determined based on experimental results, namely, in consideration of the number of dimples, dimple specification, and mainly the ratio of the area of dimples to surface area of S zone and the ratio of the area of dimples to the surface area of P zone. That is, if the ratio of the area of dimples to the surface area of the golf ball is great, i.e., the more densely dimples are arranged on the surface of the golf ball, the greater becomes the difference in the dimple effect between S zone including the great circle 11 corresponding to the seam having no dimples formed thereon and P zone in which dimples are densely arranged. On the other hand, if the ratio of the area of dimples to the surface area of the golf ball is small, the difference in the dimple effect between S zone and P zone becomes small. Accordingly, if the ratio of the area of dimples to the surface of the golf ball is small, preferably, VS/VP is 1.02 or more and on the other hand, if the ratio of the area of dimples to the surface of the golf ball is great, preferably, VS/VP is 1.25 or less.

The reason the central angle $\theta$ which divides the surface of the golf ball into S zone and P zone is 10° or more and less than 60° is because if the central angle 74 is less than 10°, dimples are arranged in S zone in an extremely reduced number. Consequently, the surface of the golf ball is divided into S zone and P zone without effect and the volume of dimples are varied without effect as well. If the central angle $\theta$ is more than 60°, the dimple effect of S zone is greater than that of P zone. Consequently, the aerodynamic symmetrical property of the golf ball cannot be improved. Accordingly, the central angle $\theta$ can be appropriately set in the range of 10° or more and less than 60° depending on a dimple arrangement, the construction of the golf ball, and mixing proportion of materials of the golf ball.

Figure 4:
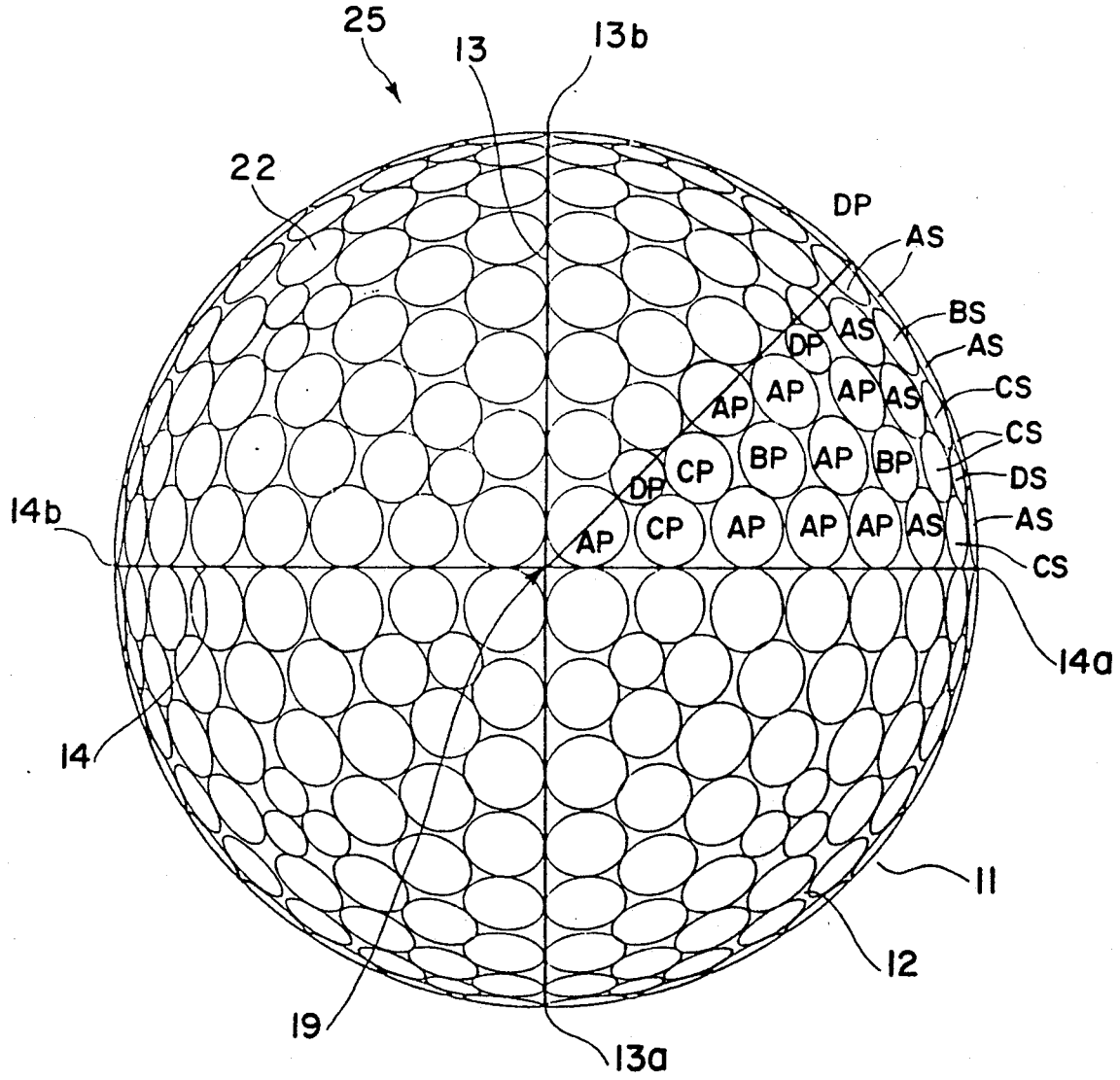
FIG. 4A is a plan view showing a golf ball according to a first embodiment of the present invention.
FIG. 4B is a side elevation showing the golf ball, shown in FIG. 4A, viewed from the right side thereof.
Figure 4:
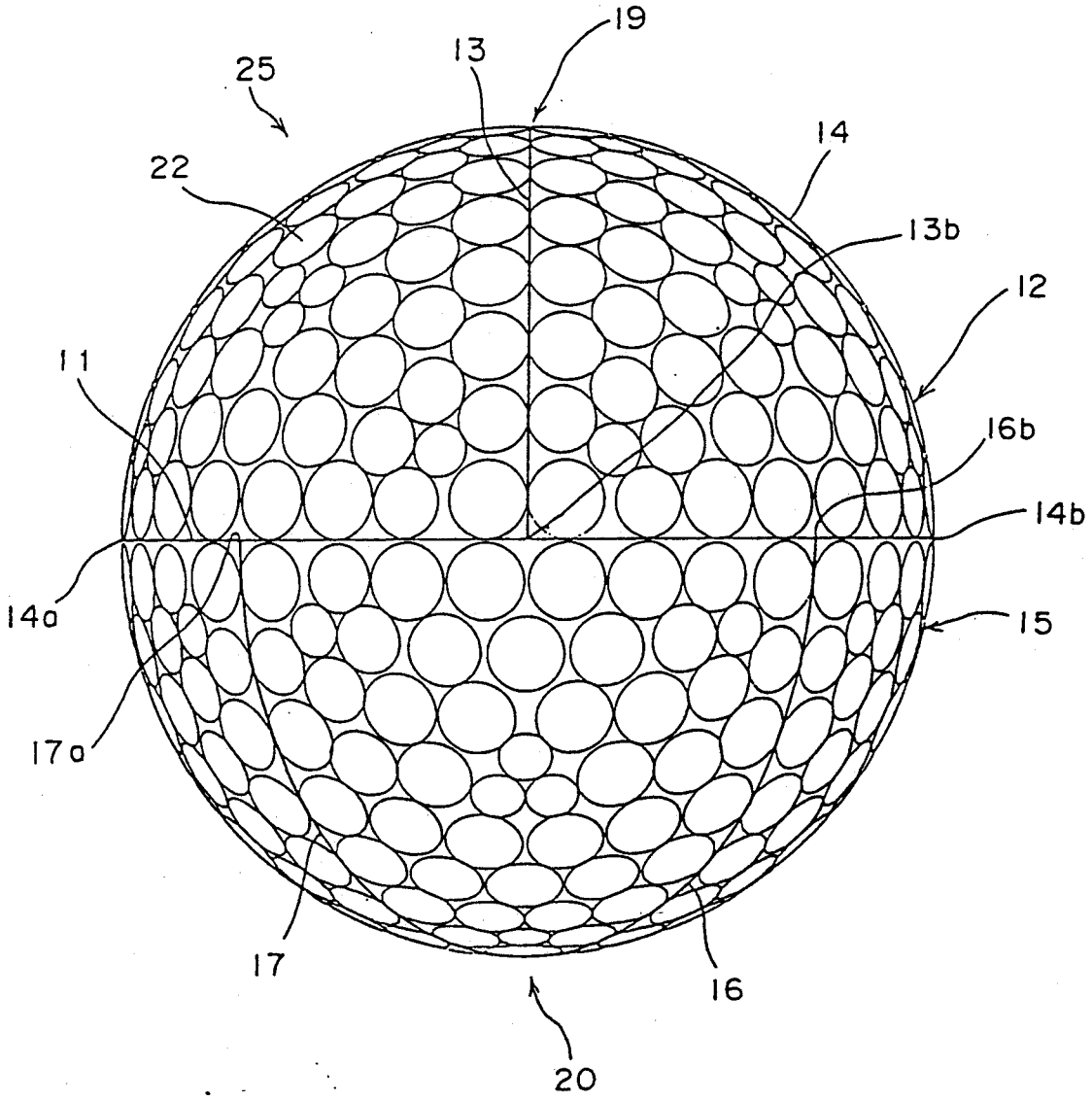

FIGS. 4A and 4B show a golf ball 25, according to a first embodiment of the present invention, having the octahedral dimple arrangement and a dimple specification as shown in Table 1. The golf ball 25 is formed with a pair of molds, with the upper mold rotated a certain angle with respect the lower mold so as to form four one-half great circles as described previously. Therefore, the golf ball 25 has one great circle and four one-half great circles on the surface thereof. FIG. 4A is a plan view showing the golf ball 25 with the pole 19 placed uppermost. Therefore, the circumference of the golf ball 25 in FIG. 4A shows the great circle 11. FIG.

4B is a side elevation viewed from the right side of the golf ball 25 shown in FIG. 4A.

The golf ball 25 has on the surface thereof 408 dimples formed, one great circle 11, and four one-half great circles 13, 14, 16, and 17. When the golf ball 25 is formed, the upper mold is connected with the lower mold by rotating the upper mold with relative to the lower mold so that the angle $\phi$ made by lines connecting the center of the golf ball 25 and adjacent two one-half great circles on the great circle 11 is 45°. The surface of the golf ball 25 is divided into S zone and P zone by the circumference corresponding to a central angle $\theta$ of 30°. Both P zone and S zone have four kinds of dimples A, B, C, and D which are different from each other in curvature $\rho$.

As shown in FIG. 4A, the dimples (A) arranged in S zone are denoted by AS, BS, CS, and DS. Similarly, the dimples (A) arranged in P zone are denoted by AP, BP, CP, and DP.

The volumes of dimples having the same curvature $\rho$ in S and P zones are differentiated by varying the diameter (R) and depth (t) thereof. That is, the diameter and depth of AS dimple are greater than those of AP dimple so that the ratio of the volume of AS dimple to the volume of AP dimple is 1.10. Similarly, dimple specification is set so that the volume ratio of BS dimple to BP dimple; CS dimple to CP dimple; and DS dimple to DP dimple is each set to 1.10.

That is, in the first embodiment, in the case of dimples having the same curvature $\rho$, VS/VP=1.10, where VS is the volume of the dimple arranged in S zone and VP is the volume of the dimple arranged in P zone.

Figure 5:
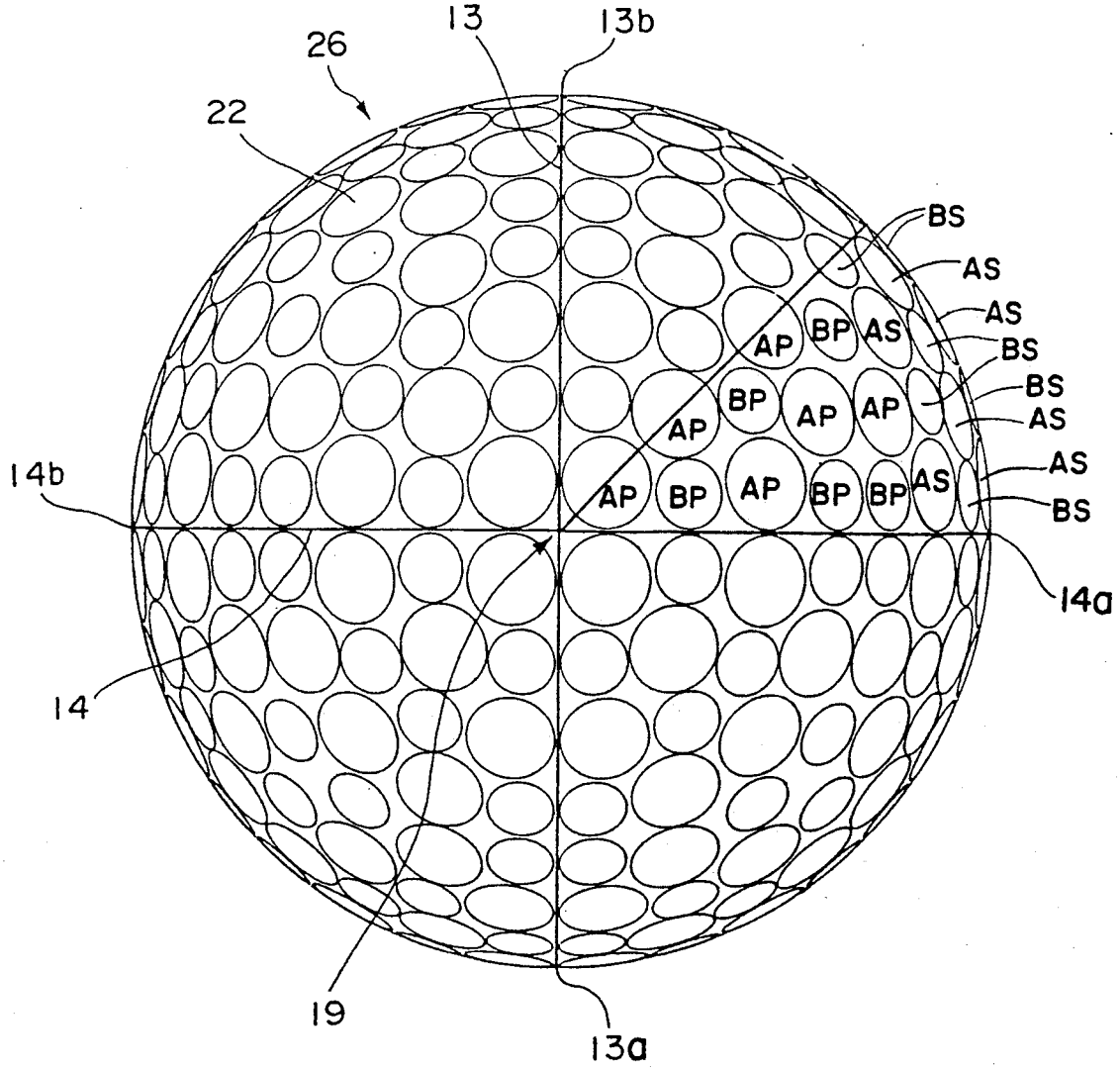
FIG. 5A is a plan view showing a golf ball according to a second embodiment of the present invention.
FIG. 5B is a side elevation showing the golf ball, shown in FIG. 5A, viewed from the right side thereof.
Figure 5B:
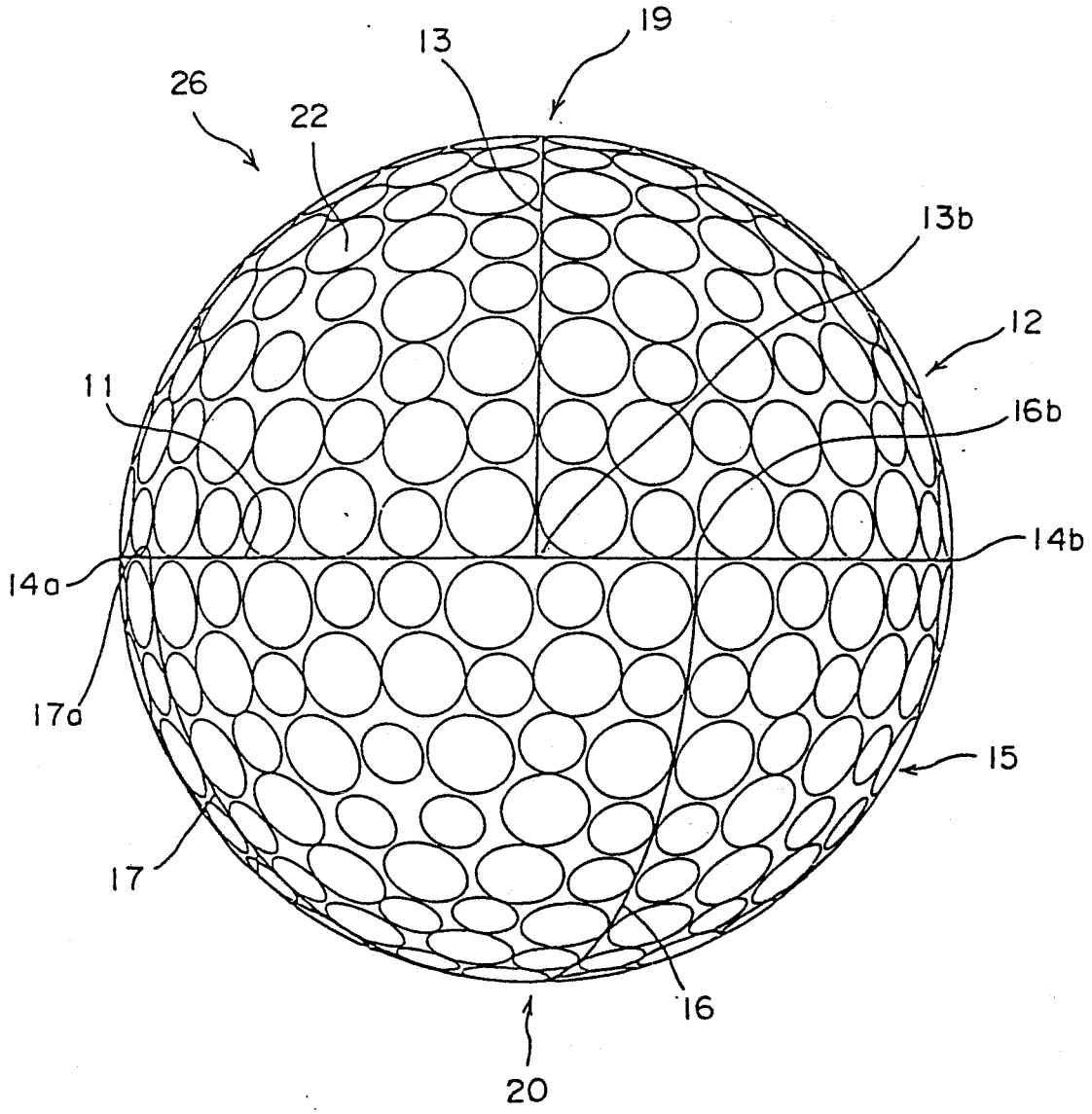

FIGS. 5A and 5B show a golf ball 26 according to a second embodiment of the present invention.

embodiment, the golf ball 26 has on the surface thereof one great circle 11 and four one-half great circles 13, 14, 16, and 17.

The golf ball 26 of the second embodiment has two kinds of dimples A and B which are differentiated from each other in curvature $\rho$. Therefore, supposing that the curvature of a dimple AS is identical to that of a dimple AP, dimple specification, namely, the diameter and depth of the dimple AS are greater than those of the dimple AP so that the volume ratio VS/VP is 1.07, similarly to the golf ball 1 of the first embodiment.

Figure 10:
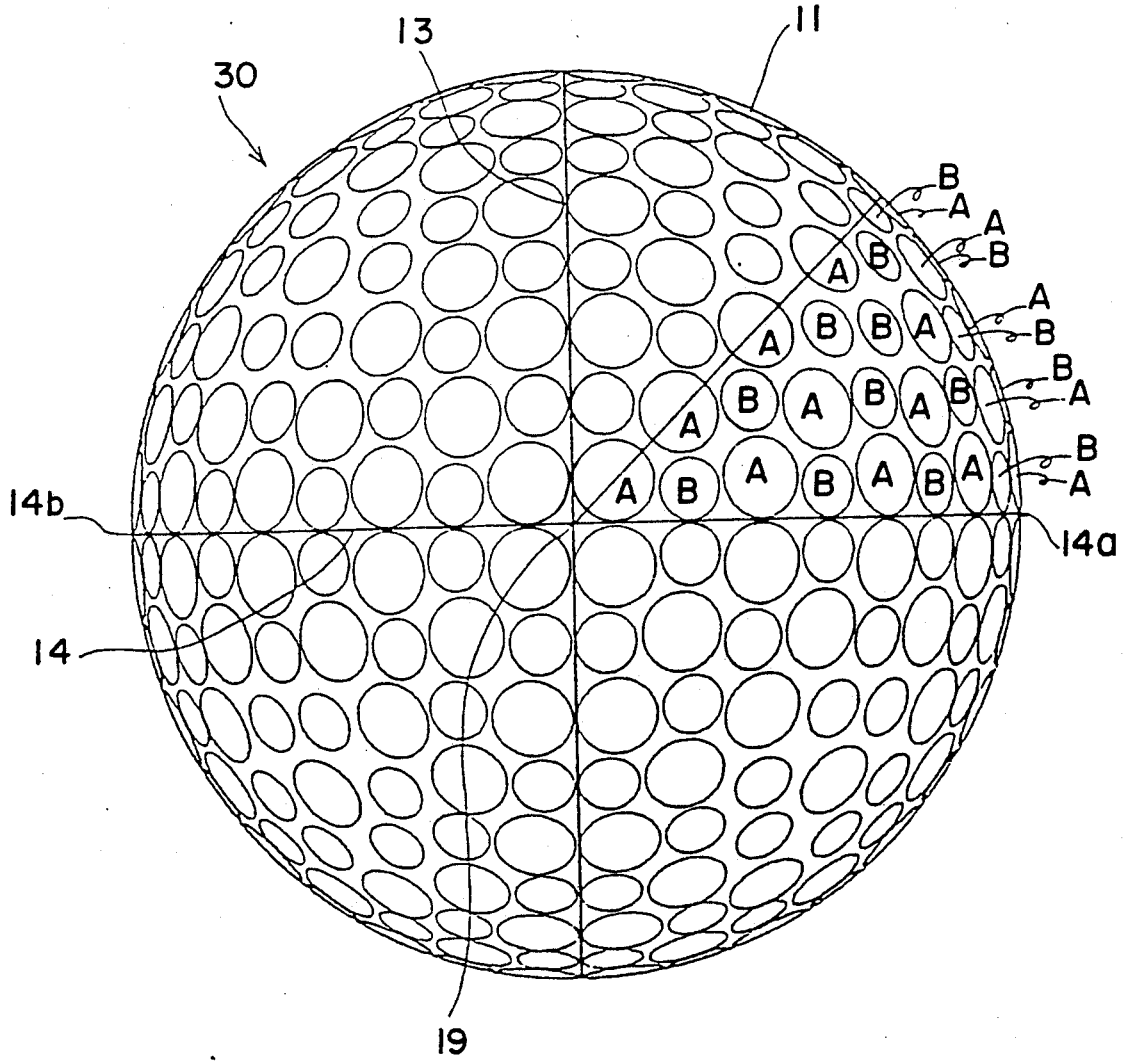
FIG. 10A is a plan view showing a golf ball according to a third embodiment of the present invention.
FIG. 10B is a side elevation showing in the golf ball, shown in FIG. 10A, viewed from the right side thereof.
Figure 10:
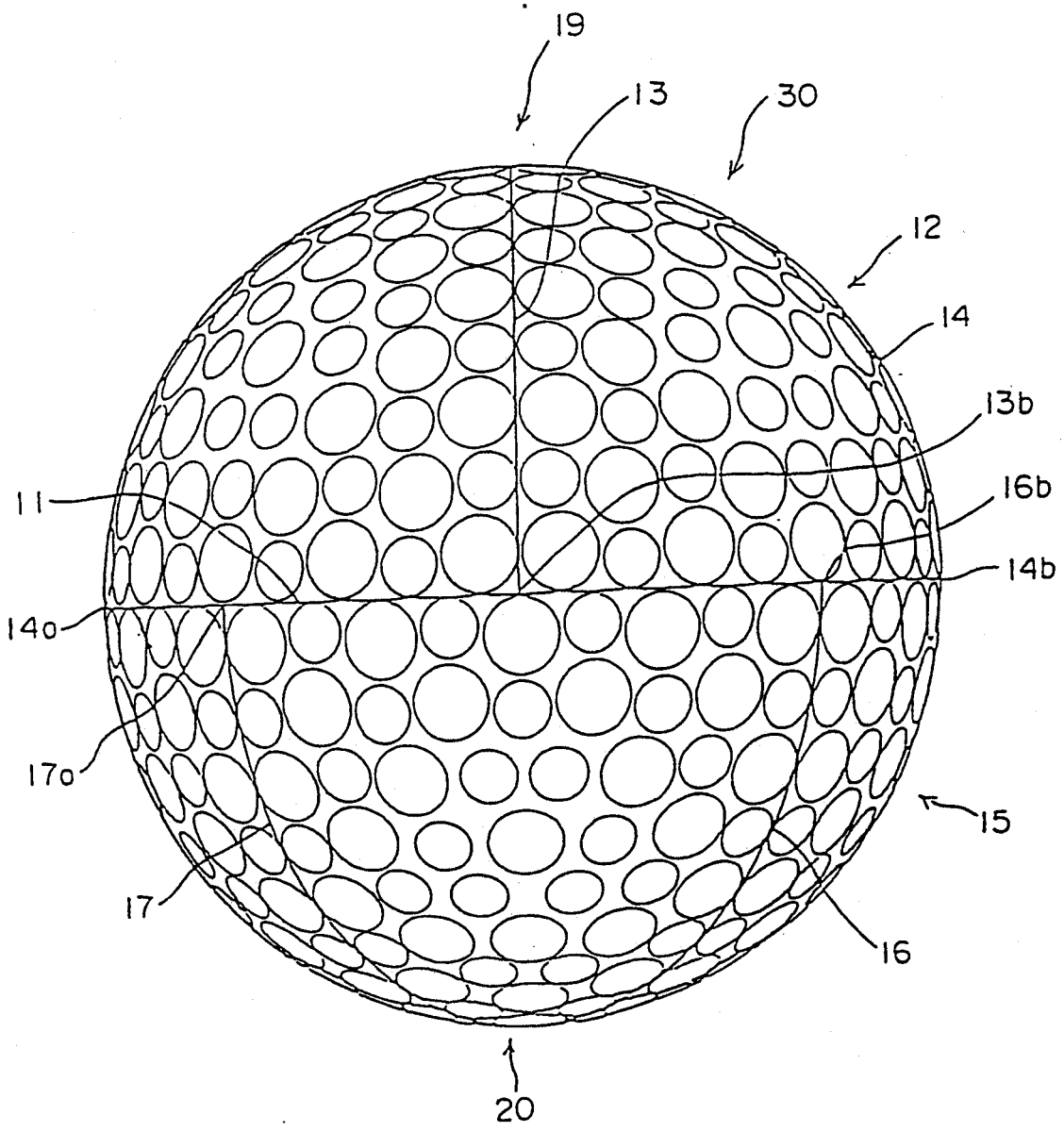

FIGS. 10A and 10B show a third embodiment in accordance with the present invention.

As shown in Tables 1 and 2 below, the golf ball 30 has 416 dimples arranged thereon. The upper mold is rotated an angle of 45° relative to the lower mold. Therefore, similarly to the first embodiment, the golf ball 30 has on the surface thereof one great circle 11 and four one-half great circles 13, 14, 16, and 17.

The golf ball 30 of the third embodiment has two kinds of dimples A and B which are differentiated from each other in curvature $\rho$. According to the third embodiment, the diameter and depth of the dimples A in S zone and P zone are equal to each other. Similarly, the diameter and depth of the dimple B in S zone and P zone are equal to each other. Therefore, the volume of each of the dimples A in S zone and P zone is equal to each other. Similarly, the volume of each of the dimples B in S zone and P zone is equal to each other. On the contrary, according to the first and second embodiments, the ratio of the volume of the dimple in P zone to the volume of the dimple in S zone is differentiated from each other, while the curvature $\rho$ of the dimples in S zone and P zone are equal to each other.

TABLE 1

| | total number of dimples | kind of dimples | dimple Specification: number of dimples | diameter (mm) | depth (mm) | volume ($mm^3$) | curvature (mm) | total volume ($mm^3$) |
|---|---|---|---|---|---|---|---|---|
| first E | 408 | A S | 88 | 4.11 | 0.17 | 1.13 | 12.5 | 383 |
| first C | | A P | 128 | 4.01 | 0.16 | 1.02 | | |
| | | B S | 16 | 3.96 | 0.17 | 1.05 | 11.6 | |
| | | B P | 32 | 3.87 | 0.16 | 0.96 | | |
| | | C S | 64 | 3.63 | 0.17 | 0.87 | 9.9 | |
| | | C P | 32 | 3.54 | 0.16 | 0.79 | | |
| | | D S | 16 | 2.84 | 0.17 | 0.55 | 6.0 | |
| | | D P | 32 | 2.78 | 0.16 | 0.50 | | |
| second E | 336 | A S | 96 | 4.53 | 0.19 | 1.49 | 14.0 | 383 |
| second C | | A P | 72 | 4.46 | 0.18 | 1.39 | | |
| | | B S | 88 | 3.42 | 0.19 | 0.86 | 8.0 | |
| | | B P | 80 | 3.37 | 0.18 | 0.80 | | |
| third E | 416 | A | 200 | 3.95 | 0.19 | 1.18 | 10.3 | 383 |
| third C | | B | 216 | 3.00 | 0.19 | 0.68 | 6.0 | |

E: embodiment, C: comparison

TABLE 2

Figure 6:
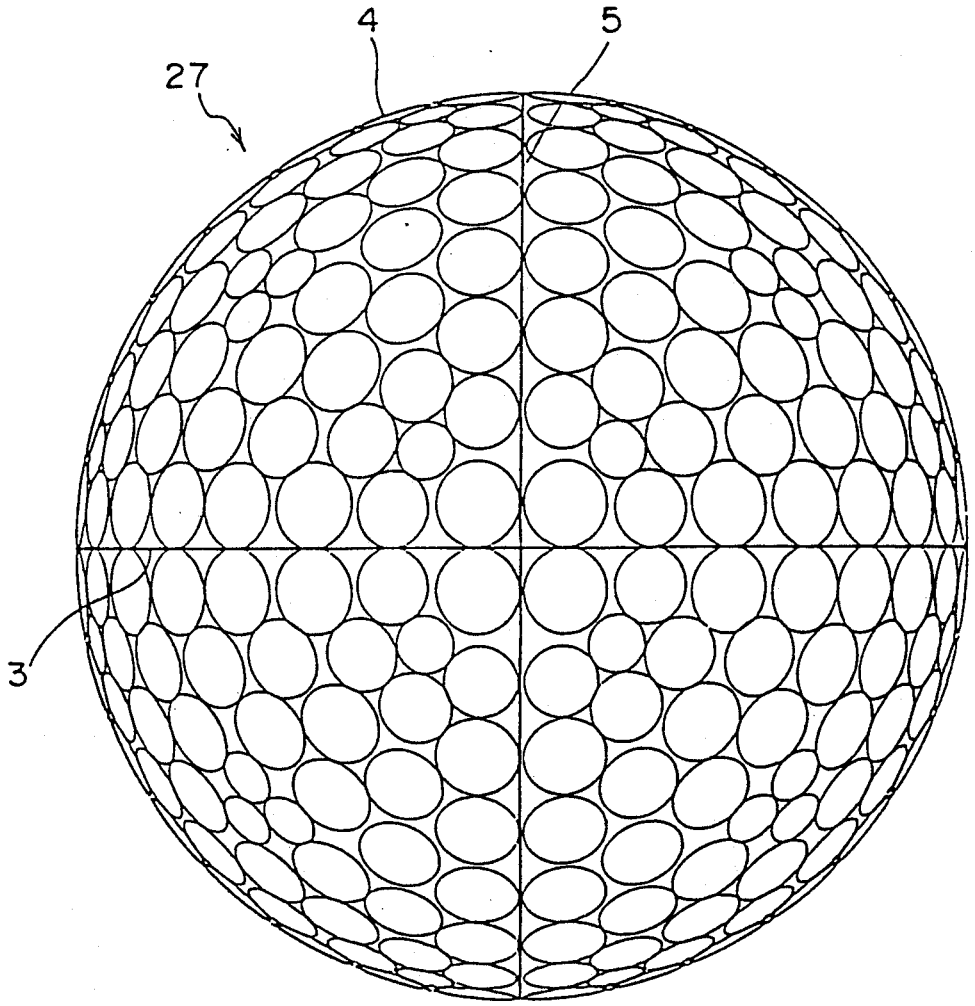
FIG. 6 is a side elevation showing a first comparison golf ball viewed from the right side thereof.
Figure 7:
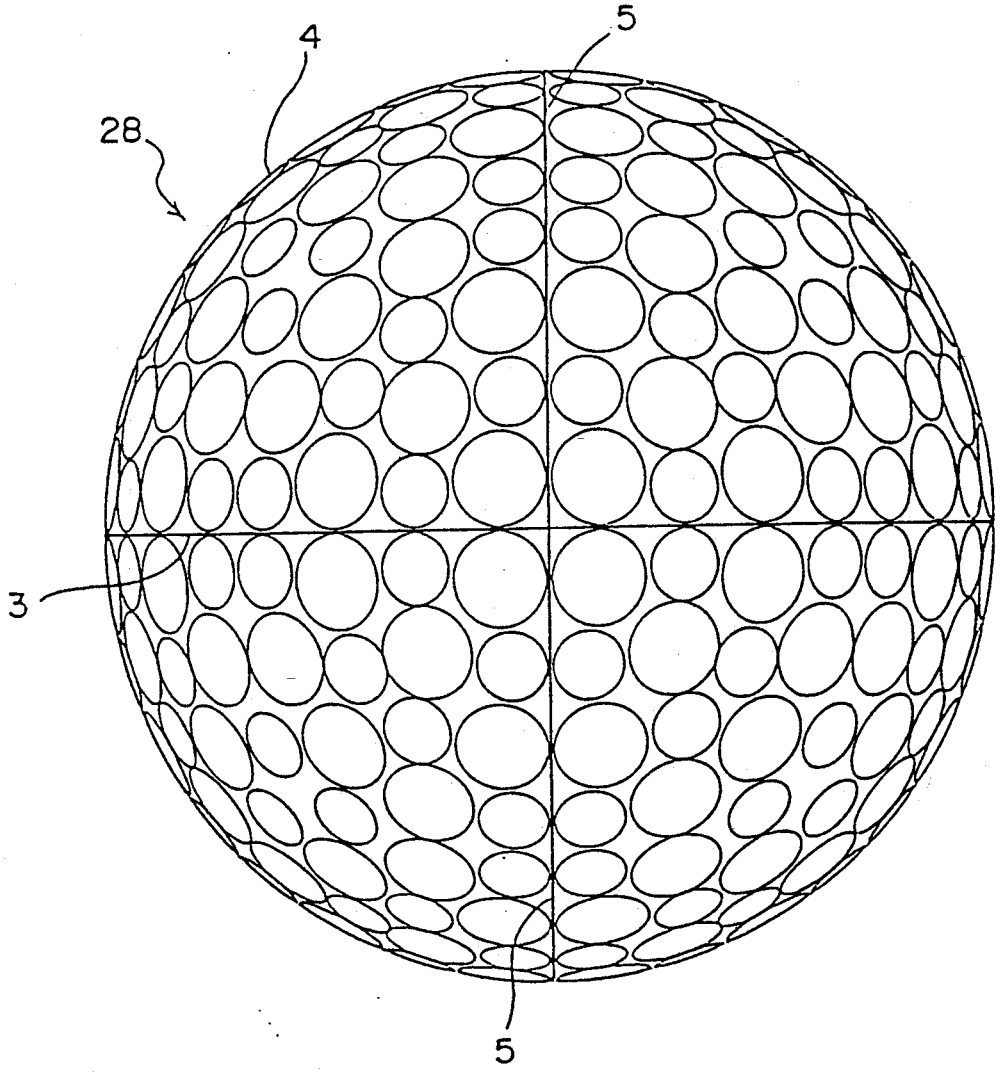
FIG. 7 is a side elevation showing a second comparison golf ball viewed from the right side thereof.
Figure 8:
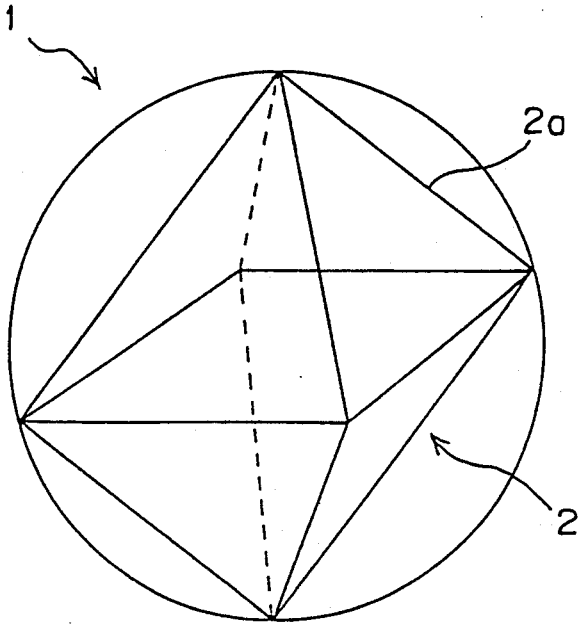
FIG. 8 is schematic view showing the concept of regular octahedral dimple arrangement.
Figure 11:
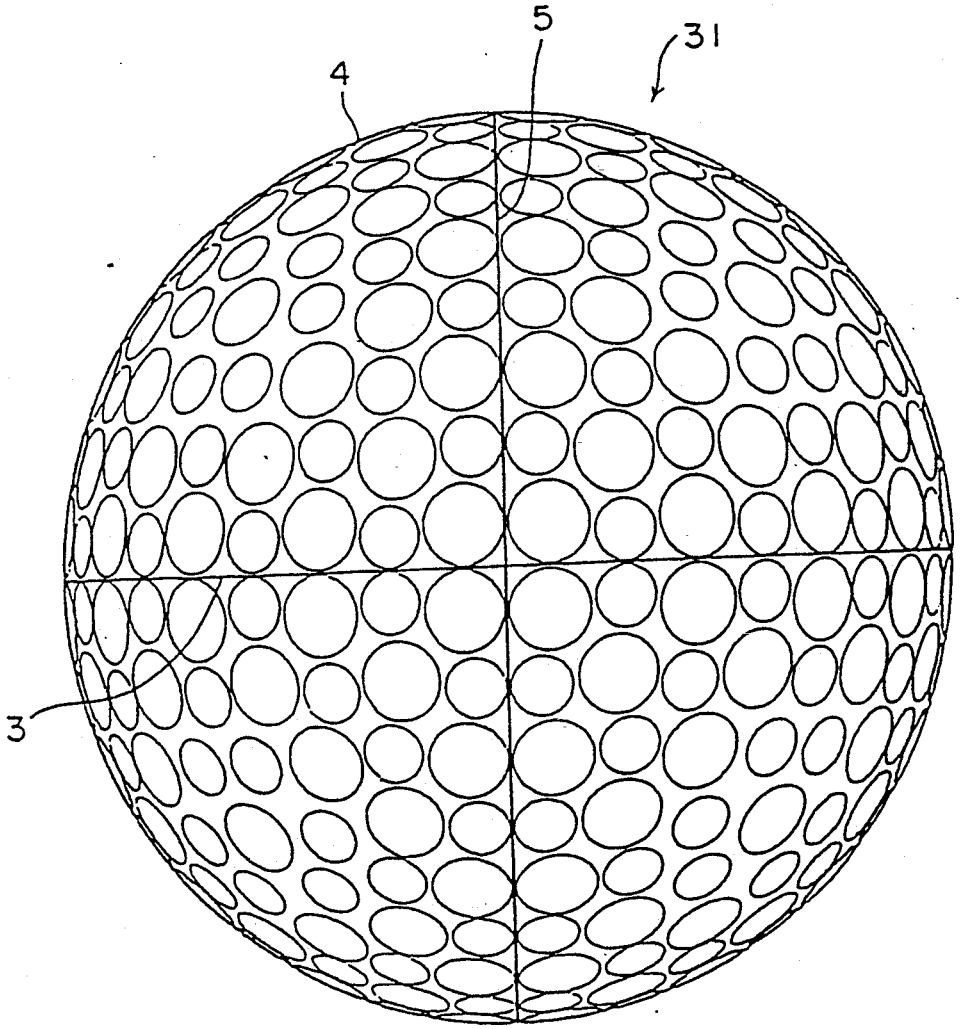
FIG. 11 is a side elevation showing a third comparison golf ball viewed from the right side thereof.

| | total number of dimples | shift angle between molds | number of great circles | number of one-half great circles | plan view | right side elevation |
|---|---|---|---|---|---|---|
| first E | 408 | 45° | 1 | 4 | FIG. 4A | FIG. 4B |
| first C | 408 | 0° | 3 | 0 | FIG. 4A | FIG. 6 |
| second E | 336 | 22.5° | 1 | 4 | FIG. 5A | FIG. 5B |
| second C | 336 | 0° | 3 | 0 | FIG. 5A | FIG. 7 |
| third E | 416 | 45° | 1 | 4 | FIG. 10A | FIG. 10B |
| third C | 416 | 0° | 3 | 0 | FIG. 10A | FIG. 11 |

As shown in Tables 1 and 2 below, the golf ball 26 has 336 dimples arranged thereon. The upper mold is rotated an angle of 22.5° relative to the lower mold, i.e., the upper semisphere 12 is rotated 22.5° with respect the lower semisphere 15. Therefore, similarly to the first In order to examine the operation and effect of the aerodynamic symmetrical property of the golf ball in accordance with the present invention, first, second, and third comparison golf balls having specification as shown in Tables 1 and 2 are provided for comparison with golf balls according to the first, second, and third embodiments.

The first, second, and third comparison golf ball 27, 28, and 31 as shown in FIG. 6, FIG. 7, and, FIG. 11 have the same dimple specification as that of the golf ball of the first, second, and third embodiment, respectively. But the first, second, and third comparison golf balls are formed by not rotating the upper mold relative to the lower mold, namely the shift angle $\phi$ is set 0°. The first, second, and third comparison golf balls have regular octahedral dimple arrangement. Therefore, they have one great circle 3 corresponding to the seam between the upper and lower molds and two great circles 4 and 5 corresponding to semi-seams, but have no one-half great circles whereas the golf balls of the first, second, and third embodiments have one-half great circles, respectively. Consequently, the plan view of the first, second, and third comparison golf balls 27, 28, and 31 are identical to the plan view FIGS. 4A, 5A, and 10A of the golf balls of the first, second, and third embodiments, respectively, however, the right side elevations of the golf ball of the embodiments and the comparison golf balls are different from each other. That is, FIG. 4B and FIG. 6 are different from each other. Similarly, FIG. 5B and FIG. 7 are different from each other and FIG. 10B and FIG. 11 are different from each other.

The golf balls 25, 26, and 30 of the first, second, and third embodiments, the first comparison golf balls 27, the second comparison golf balls 28, and the third comparison golf balls 31 comprise thread wound around a liquid center and a balata cover, and have the same construction composed of materials of the same mixing proportion. The outer diameter are each 42.70±0.03 mm and the compression are each 95±2.

Experiment 1

Symmetrical property test were conducted on the golf balls of the first and second embodiments and the first and second comparison golf balls using a swing robot manufactured by True Temper Corp. The golf balls were hit by a driver (No. 1 wood) at a head speed of 48.8 m/s, at a spin of 3500±300 rpm, and a launching angle of 9±0.5°. The wind was fair at a speed of 0.5~3.2 m/s. The number of golf balls of the first embodiment, second embodiment, the first comparison golf balls, and second comparison golf balls was 60, respectively. Temperature of the golf ball were kept at 23° C. ± 1° C.

Of 60 test balls of each of the first and second embodiments, 20 golf balls were used each for seam hitting, half-seam hitting, and on non-seam hitting, respectively. Similarly, of 60 test balls of each of the first and second comparison examples, 20 golf balls were used each for seam hitting, semi-seam hitting, and non-seam hitting.

Carry, trajectory height (angle of elevation viewed from a launching point of golf ball to the highest point thereof in trajectory), and duration of flight were measured to test the symmetrical property of each golf ball. flight durations are shown in Table 3.

TABLE 3

| | Symmetrical property test | | | |
|---|---|---|---|---|
| | kind of hitting | carry (m) | trajectory height | duration of flight (second) |
| first E | seam | 234.8 | 13.80 | 5.80 |

TABLE 3-continued

| | Symmetrical property test | | | |
|---|---|---|---|---|
| | kind of hitting | carry (m) | trajectory height | duration of flight (second) |
| | half-seam | 234.5 | 13.69 | 5.80 |
| | non-seam | 235.5 | 13.88 | 5.88 |
| second E | seam | 238.0 | 14.33 | 6.19 |
| | half-seam | 237.1 | 14.20 | 6.12 |
| | non-seam | 237.3 | 14.33 | 6.23 |
| first C | seam | 234.6 | 13.89 | 5.88 |
| | semi-seam | 229.9 | 13.25 | 5.35 |
| | non-seam | 235.0 | 13.94 | 5.91 |
| second C | seam | 237.1 | 14.30 | 6.22 |
| | semi-seam | 231.9 | 13.80 | 5.86 |
| | non-seam | 236.6 | 14.26 | 6.17 |

E: embodiment, C: comparison

As shown in Table 3, golf balls of the first and second embodiments had smaller differences than the comparison golf balls in the carry, trajectory height, and duration of flight between seam hitting, half-seam hitting, and non-seam hitting. That is, the golf balls of the first and second embodiments had smaller differences than the comparison golf balls in the trajectory between seam hitting, half-seam hitting, and non-seam hitting. On the other hand, according to the first and second comparison golf balls, the trajectory height in semi-seam hitting was lower and the carry as well as the duration of flight in semi-seam hitting were shorter than those in seam-hitting and non-seam hitting.

That is, the aerodynamic symmetrical property of the golf balls of the first and second embodiments are more favorable than that of the first and second comparison golf balls, so that the trajectory of the former was smaller than those of the latter irrespective of the shift of a rotational axis thereof.

Experiment 2

Symmetrical property test was conducted on the golf balls of the third embodiment and the third comparison golf balls in the same condition as that of Experiment 1 except that the golf balls were hit against the wind. The wind speed was 0.4~1.8 m/s. The result of Experiment 2 is shown in Table 4 below.

As apparent from Table 4, according to the golf balls of the third embodiment, the trajectory height in seam hitting was lower and the carry as well as the duration of flight in seam hitting were shorter than those in half-hitting and non-seam hitting. According to the third comparison golf balls, the trajectory height in seam hitting and semi-seam hitting was lower and the carry as well as the duration of flight in seam hitting and semi-seam hitting were shorter than that in non-seam hitting.

The third comparison golf balls have one great circle and two semi-seams thereon while the golf ball of the third embodiment has one seam and no semi-seams thereon. Therefore, the golf ball of the third embodiment has a low probability that the seam rotates fastest in its backspin, and has an aerodynamic symmetrical property more favorable than that of the third comparison golf ball.

TABLE 4

| | Symmetrical Property Test | | | |
|---|---|---|---|---|
| | kind of hitting | carry (m) | trajectory height | duration of flight (second) |
| third E | seam | 221.5 | 13.22 | 5.10 |
| | half-seam | 227.6 | 13.69 | 5.59 |
| | non-seam | 228.8 | 13.73 | 5.65 |
| third C | seam | 220.3 | 13.18 | 5.07 |

TABLE 4-continued

| Symmetrical Property Test | | | |
|---|---|---|---|
| kind of hitting | carry (m) | trajectory height | duration of flight (second) |
| semi-seam | 221.4 | 13.23 | 5.10 |
| non-seam | 228.4 | 13.70 | 5.62 |

E: embodiment, C: comparison

As apparent from the foregoing description, without damaging a favorable symmetrical property and fine view of regular octahedral dimple arrangement, the golf ball in accordance with the present invention is capable of achieving a flight performance more favorable than that of the conventional golf ball. Therefore, according to the present invention, the difference in trajectories of the golf ball are small even though the rotational axis of the backspin is shifted, so that the golf ball can reflect a player's ability correctly. Further, the goif ball according to the present invention can be easily formed with upper and lower molds which are brought into contact with each other by rotating the upper mold a desired angle relative to the lower mold.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A golf ball having 300 to 500 dimples on a spherical surface thereof, said golf ball comprising:

one great circle and four one-half great circles intersecting no dimples in which eight end points including two end points of each one-half great circle do not coincide with each other on said great circle, one of said one-half great circles intersecting the other one-half great circle at a right angle at the middle point thereof on each side of said, great circle.

2. The golf ball as claimed in claim 1, wherein said great circle coincides with the seam of a pair of semi-spherical molds.

3. The golf ball as claimed in claim 2, wherein the specification of a dimple arranged in an S spherical zone and the specification of a dimple arranged in a P spherical zone is determined so that VS/VP are in the range:

$$1.02 \leqq VS/VP \leqq 1.25$$

where said S spherical zone ranges from said seam to each of circumferences formed in correspondence with a central angle of less than approximately 60° with respect to said seam; said P spherical zone ranges from said circumferences to each pole; VS is the volume of a dimple arranged in said S spherical zone; and VP is the volume of a dimple, having the same curvature as that of said dimple of said S spherical zone, arranged in said P spherical zone.

4. The golf ball as claimed in any one of claims 1 through 3, wherein of said eight end points, the central angle $\phi$ formed by lines connecting the center of said golf ball and each of two end points adjacent to each other is set in the following range:

$$5° \leqq \phi \leqq 45°.$$

5. The golf ball as claimed in claim 1, wherein the dimples cover substantially the entire spherical surface of the golf ball.

* * * * *